United States Patent [19]

Henry et al.

[11] Patent Number: 4,928,874

[45] Date of Patent: May 29, 1990

[54] MAILER-LIKE BUSINESS FORM WITH TRANSPARENT FRONT

[75] Inventors: Paul T. Henry, Palatine; Roger L. Haase, Arlington Heights; Gary W. Fitzgibbons, Barrington, all of Ill.

[73] Assignee: Uarco Incorporated, Barrington, Ill.

[21] Appl. No.: 433,669

[22] Filed: Nov. 8, 1989

[51] Int. Cl.[5] ..... B65D 27/00; B65D 27/30

[52] U.S. Cl. ..... 229/74; 282/11.5 A; 282/25

[58] Field of Search ..... 229/74; 282/11.5 A, 282/11.5 R, 25

[56] References Cited

U.S. PATENT DOCUMENTS

| | | | |
|---|---|---|---|
| 3,987,960 | 10/1976 | Gardiner | 229/74 |
| 4,153,163 | 5/1979 | Alderman et al. | 229/74 |
| 4,343,492 | 8/1982 | Fitzgibbons | 229/74 |
| 4,407,524 | 10/1983 | Trautlein | 229/74 |

FOREIGN PATENT DOCUMENTS

| | | | |
|---|---|---|---|
| 2526715 | 11/1983 | France | 282/11.5 R |

*Primary Examiner*—Stephen P. Garbe

*Attorney, Agent, or Firm*—Wood, Phillips, Mason, Recktenwald & VanSanten

[57] ABSTRACT

A business form for use in shipping operations including a sheet 22 of face stock material having pressure sensitive adhesive 28 on one side thereof, a release liner 24 removably adhered to the pressure sensitive adhesive 28, a transparent sheet 16 adhered to along two spaced marginal edges to the face stock sheet 22 and having a marginal edge 60 stopping short of the corresponding edge 62 of the face stock sheet, and at least one pressure sensitive imaging data sheet 18, 20 between the transparent sheet 16 and the face stock sheet and having marginal edges 70, 72, 74, 76 inward of the two marginal edges of the transparent sheet 16 so as to be free from adhesion thereto and having a third marginal edge 64, 66 extending past the one marginal edge 60 of the transparent sheet 16.

12 Claims, 3 Drawing Sheets

MAILER-LIKE BUSINESS FORM WITH TRANSPARENT FRONT

FIELD OF THE INVENTION

This invention relates to business forms, and more particularly, to a mailer-like business form provided with a transparent front of plastic or the like for application to cartons to be shipped.

BACKGROUND OF THE INVENTION

Prior art of possible relevance includes Alderman patent No. 4,153,163 and Gardiner patent No. 3,987,960. Alderman discloses a combination envelope and form assembly for use in shipping operations while Gardiner discloses a shipping form containing several data sheets in the form of an envelope or a pouch.

The ability to add variable information such as addresses and the identity and quantity of products to be shipped to business forms by a computerized printer has resulted in a substantial increase in the use of business forms in shipping operations.

In many cases, the business form includes pressure sensitive adhesive whereby the same may be adhered to a carton to be shipped and in addition, includes some sort of transparent film or ply overlying a label part of the business form to provide protection for the label against soiling or other obliterating acts that would obscure the address information.

Not infrequently, heat seals are utilized to secure the film material to other components and the heat sealing process is undesirably slow, making business forms that require heat sealing more expensive than they would be if heat sealing were not required.

In other commercially manufactured forms, it is possible to physically separate the transparent film from the face stock and then reapply the same, leaving no indication that the form has been disturbed or otherwise opened.

The present invention is directed to overcoming one or more of the above problems.

SUMMARY OF THE INVENTION

It is a principal object of the invention to provide a new and improved business form. More specifically, it is an object of the invention to provide a mailer-like business form that may be utilized in shipping operations.

An exemplary embodiment of the invention achieves the foregoing object and a business form that includes a sheet of face stock having pressure sensitive adhesive on one side and a release liner removably adhered thereto. A transparent sheet is adhered along two spaced marginal edges to the face stock sheet on a side thereof opposite the pressure sensitive adhesive with at least one marginal edge terminating short of the corresponding marginal edge of the face stock sheet and being free from adhesion thereto. At least one pressure sensitive data sheet is then located between the transparent sheet and the face stock sheet and has marginal edges inwardly of the two marginal edges so as to be free from adhesion to the transparent sheet and the face stock sheet thereat and having a third marginal edge extending past the one marginal edge of the transparent sheet to be grippable thereat and removed from the form.

In a highly preferred embodiment, there are plural ones of the data sheets and their marginal edges are shingled and between the one marginal edge of the transparent sheet and the corresponding edge of the face stock sheet.

In a highly preferred embodiment, the transparent sheet is adhered to the face stock sheet by means of a cold glue adhesive. Thus, if one attempts to remove the transparent sheet from the face stock sheet, fiber tear of the paper of which the face stock sheet is made will result providing an indication that the same has been opened.

Typically, the data sheets are connected to one of the transparent and face stock sheets at their marginal edges opposite from their shingled marginal edges and have lines of weakening adjacent thereto so that the data sheets may be individually severed thereat and removed from the remainder of the business form.

A highly preferred embodiment of the invention contemplates the provision of die cut means in the face stock sheet inwardly of at least two marginal edges thereof to define at least one label separate from the remainder of the face stock sheet. As a consequence, removal of the release liner takes the label with the release liner while exposing adhesive on the remainder of the face stock sheet. The business form may thus be adhered to a container or the like by reason of the exposed adhesive and the label subsequently removed from the release liner and put to whatever purpose is desired.

Preferably, the die cut means is a closed die cut wholly within the marginal edges of the face stock sheet so that removal of the release liner will leave a frame of exposed adhesive.

The invention also contemplates that the pressure sensitive adhesive does not extend completely to at least one edge of the release liner thereby allowing one to readily grasp corresponding edges of the release liner and the face stock sheet to initiate separation of the two.

Other objects and advantages will become apparent from the following specification taken in connection with the accompanying drawings.

DESCRIPTION OF THE PREFERRED EMBODIMENTS

Figure 1:
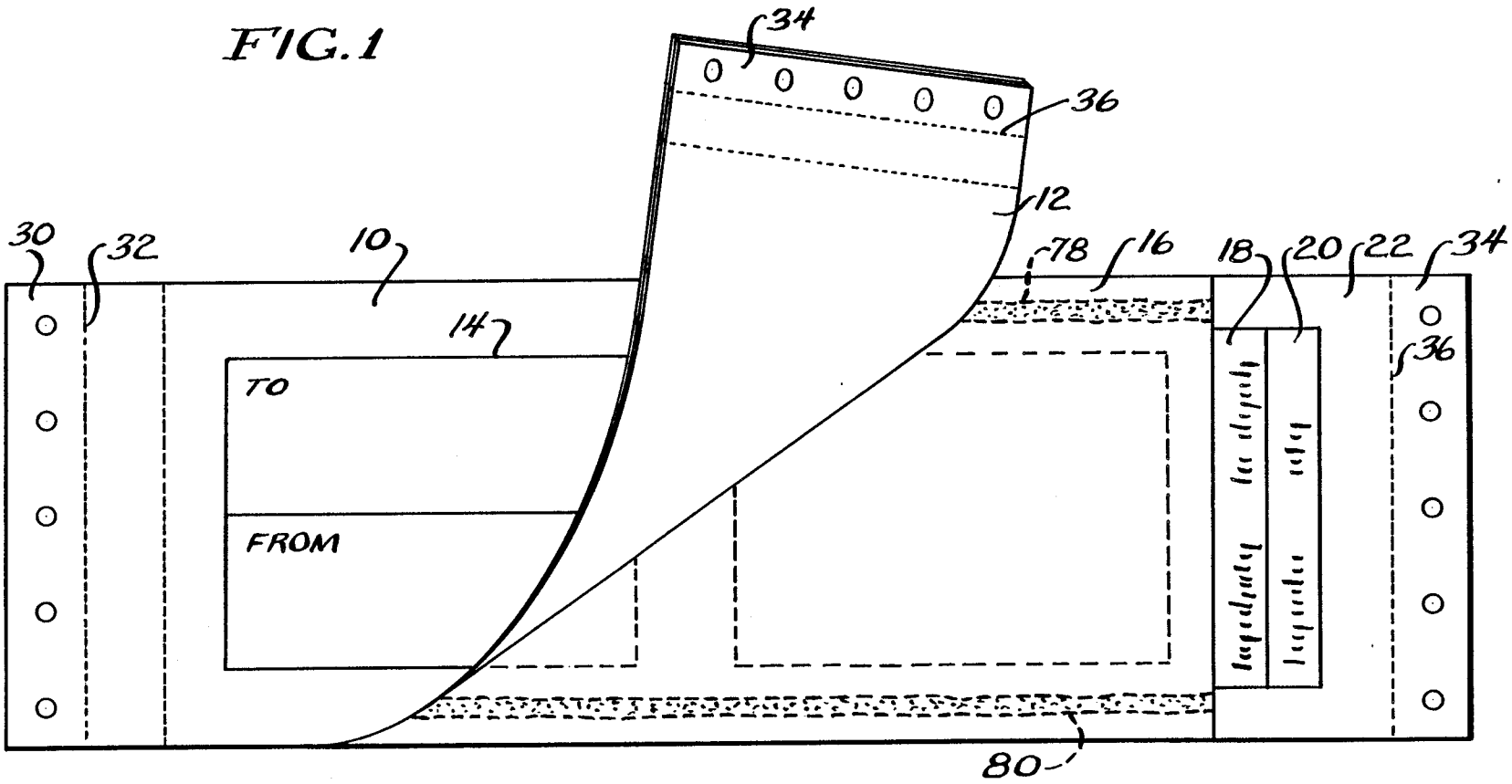
FIG. 1 is a perspective view of a business form made according to the invention with part of the form being slightly rolled back to expose underlying parts of the form.
Figure 2:
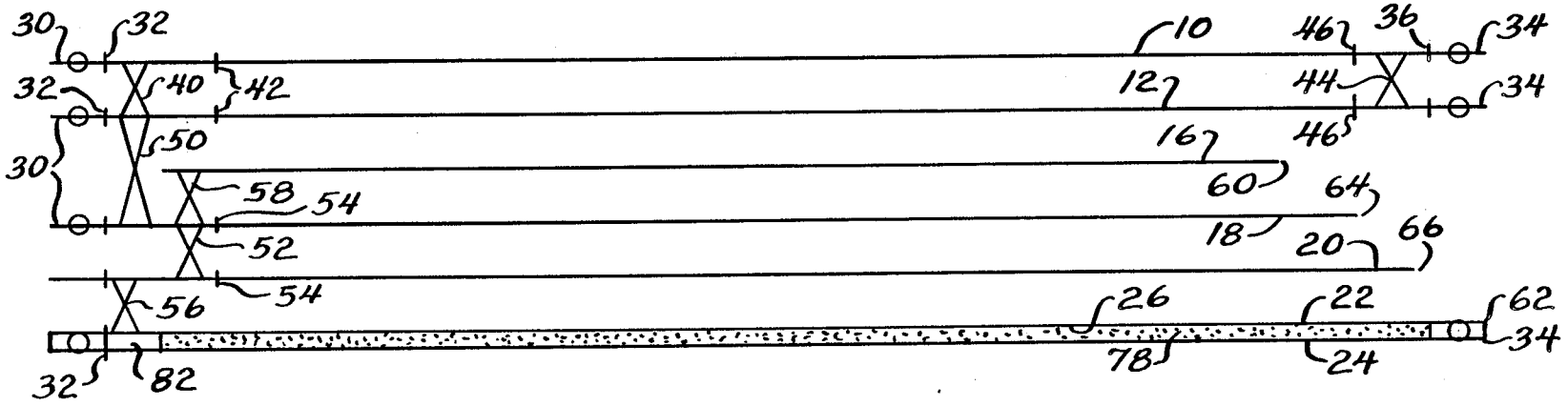
FIG. 2 is a somewhat schematic, sectional view of the business form taken from one longitudinal edge to the other.
Figure 3:
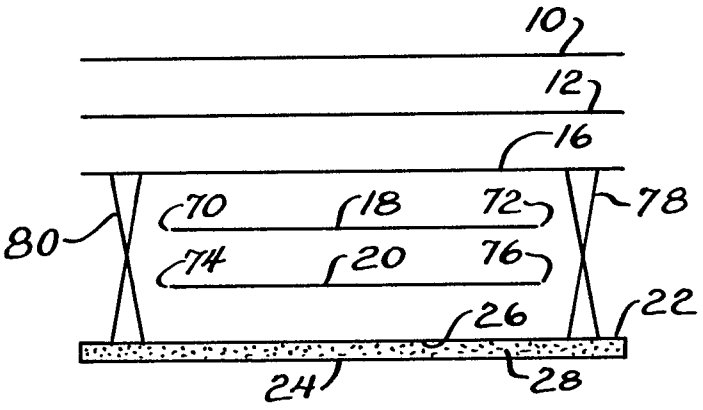
FIG. 3 is a view similar to FIG. 2 but taken from top to bottom of the form.

An exemplary embodiment of a business form made according to the invention is illustrated in the drawing and with reference to FIGS. 1, 2 and 3 is seen to be, in an exemplary embodiment, made up of seven sheets or plies. In the usual case, the form will be made on that type of equipment normally utilized to produce continuous business forms. Depending upon the desires of the customer, the same may be shipped to the customer as a continuous business form that may be subsequently severed by the customer upon the cross lines of weakening typically employed to delineate one form length from another. Alternatively, the severing of individual form lengths may be performed as part of the manufacturing operation. As described herein, the form is of the type that would result from the latter manufacturing practice but it is to be understood that the invention applies to forms that are shipped to the customer in continuous form as well.

With reference to FIG. 1, the business form includes an upper record ply 10 and a lower record ply 12 immediately thereunder. Fixed information may be preprinted in the form of indicia 14 on both such plies and image transfer means such as hot spot carbon or interleaved carbon plies may be utilized to transfer variable information printed on the ply 10 from top to bottom through the business form. Preferably, however, pressure sensitive image transfer systems such as CF/CB are utilized.

Below record plies 10 and 12 is a transparent ply 16 formed of a transparent plastic material that will provide protection for those plies that underlie the same from the elements as well as from smearing or smudging.

The exemplary embodiment provides two data plies 18 and 20 below the transparent ply 16. They in turn overlie a ply or sheet 22 of face stock material which, according to the preferred embodiment of the invention, will be a fibrous material such as paper. Underlying the face stock sheet 22 is a sheet 24 of release liner (FIGS. 2 and 3).

Referring specifically to FIGS. 2 and 3, the lower side 26 of the face stock sheet 22 is coated with pressure sensitive adhesive 28 and the release liner sheet 24 removably adhered thereto.

It will also be seen that at their left hand marginal edges, the plies 10, 12, 18, 20, 22 and 24 have so-called control punch margins 30 which are separated from the remainder of the form by longitudinal lines of weakening 32 by which the control punch margins 30 may be separated after manufacture and/or feeding through a computer printer. Alternatively, the lines of weakening 32 maybe omitted and a trimmer of conventional construction in business form processing equipment utilized to remove the control punch margins 30.

Similar control punch margins 34 may extend along the right hand longitudinal edges of the plies 10, 12, 22 and 24. Again, an optional line of weakening 36 may or may not be included in such plies to allow separation of the control punch margins 34.

In the usual case, a longitudinal glue line 40 (FIG. 2) extends between the record plies 10 and 12 just inwardly of the control punch margins 30. This glue line secures the record plies 10 and 12 together along their left hand edges and lines of weakening 42 just inwardly thereof allow separation of the sheets 10 and 12 from the resulting stub. If desired, a similar longitudinal glue line 44 may be located just inwardly of the right hand control punch margins 34 between the plies 10 and 12 and lines of weakening 46 provided inwardly thereof. The resulting stub at the right hand end of the form will be free and thus may be removed along the lines of weakening 46. Once that occurs, the record plies or sheets 10 and 12 may be individually removed from the remainder of the form as desired by severance along the lines of weakening 42.

A longitudinal glue line 50 extends between the lower most record ply 12 and the upper most data ply 18 to secure the same together. A further longitudinal glue line 52 secures the data plies 18 and 20 together and is located between the control punch margins 30 and lines of weakening 54 in the plies 18 and 20. Finally, a longitudinal glue line 56 extends between the lowermost data ply 20 and the face stock ply 22.

In addition, a longitudinal glue line 58 extends between the transparent sheet 16 and the upper most data sheet 18. The glue line 58 is located between the lines of weakening 32 and 54 in the data sheet 18 and will be formed of a cold glue adhesive so that the transparent ply 16 may be adhered to the data ply 18 without the use of a heat seal. Further, the use of cold glue adhesive at this location assures good penetration of the adhesive into the fibers making up the ply 18 preventing separation of the ply 16 and 18 without paper tear indicative of the occurrence. To assure good adhesion to the transparent ply 16, an adhesive such as Swift 47222 available from Swift Adhesives of Downers Grove, Illinois, USA may be used.

Directing attention to the right hand side of the form as illustrated in FIG. 2, it will be seen that a longitudinal edge 60 of the transparent ply 16 terminates well inward of the corresponding longitudinal edge 62 of the face stock sheet or ply 22. Longitudinal edges 64 and 66 of the data plies 18 and 20 are located intermediate the edges 60 and 62 with the across the form length of the ply 18 being less than the across the form length of the ply 20 so as to provide a shingled appearance at the right hand edge of the form. Thus, the individual edges 64 and 66 extend outwardly from under the ply 16 and are free to be individually grasped so as to be pulled to sever the lines of weakening 54 at the left hand edges of the plies 18 and 20.

As seen in FIG. 3, the top to bottom dimension of the plies 10, 12, 16, 22 and 24 is identical while the plies 18 and 20 have reduced top to bottom dimensions. As a consequence, edges 70 and 72 of the ply 18 and edges 74 and 76 of the ply 20 are located inwardly of across the form glue lines 78 and 80 which extend between the transparent ply 16 and the face stock ply 22. The glue lines 78 and 80 again are made of cold glue adhesive for the same reason as the glue line 58.

It will be readily appreciated from the foregoing description that the glue lines 78 and 80 combine with the glue line 58 to form a U-shaped pocket for the data sheets 18 and 20 and that the latter extend from the pocket at the right hand edge in shingled relation so as to allow ready grasping and severance from the remainder of the form.

In the form of the invention illustrated, the form may be imprinted upon or inscribed as desired. Typically, the ply 10 might serve as a shippers copy and may be removed from the form and retained by the shipper. The ply 12 will contain identical information and may be retained for accounting purposes and the like. The release liner 24 may be striped from the face stock 22 to expose the adhesive 28 whereby the remainder of the form made up of the transparent ply 16 and the data sheets 18 and 20 within the pocket can be adhered to a container or the like. The data ply 18 may serve as, for example, as a delivery receipt to be acknowledged and removed from the form upon receipt of the package to which the form is adhered. The data sheet 20 may serve as a consignee copy thereof.

Frequently, in order to facilitate use of the form, the face stock ply 22 will not have pressure sensitive adhesive 28 extending fully to either longitudinal edge. Thus, an uncoated area exists at the control punch margin 34 as well as at the control punch margin 30. Preferably, an area 82 inwardly of one of the control punch margins 32 or 34, shown inwardly of the control punch margin 32 in FIG. 2, is also provided. Thus, with the control punch margins 30 and 34 removed from the form, there is an area between the face stock ply and the release liner 24 where no adhesive exists, that is, the area 82, which allows both sheets to be individually gripped to facilitate separation.

In the usual case, the data sheets 18 and 20 will have self-contained, pressure sensitive imaging systems to facilitate formation of images thereon in response to impact printing or pressure printing on the ply 10. Again, so-called CF/CB or CFB systems are preferred for the purpose although at least at the interface between the plies 18 and 20, hot spot carbon or interleaved carbon could be used if desired. Generally, however, such is not desired because it increases the thickness of the form and reduces the imaging qualities on the lowermost plies of the form.

In some instances, it may be desirable to provide additional, removable labels as part of the form. Again, however, it is desirable not to increase the thickness of the form because of the reliance upon pressure sensitive imaging systems.

Figure 4:
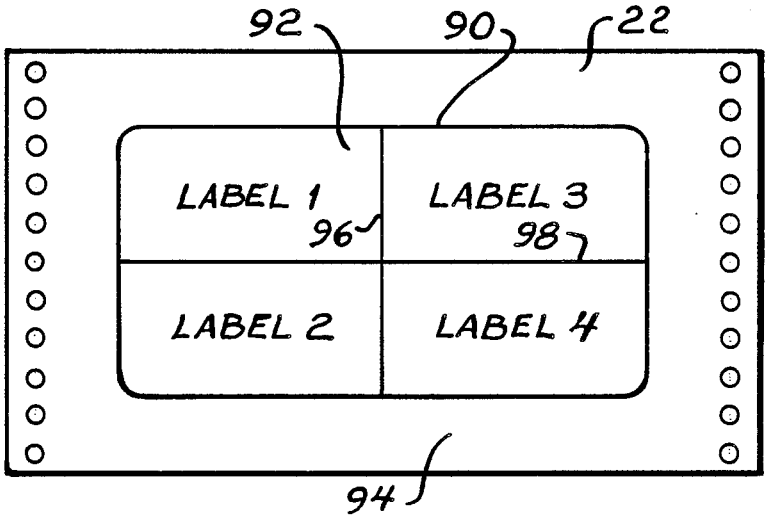
FIG. 4 is a plan view of a sheet utilizing a modified embodiment of the invention.
Figure 5:
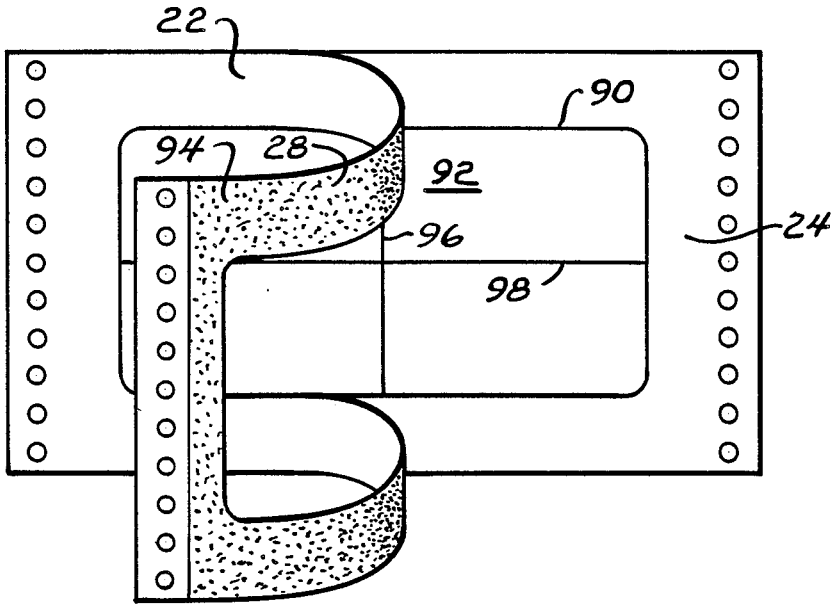
FIG. 5 is a view similar to FIG. 1 but of the sheet construction illustrated in FIG. 4.

This may be accomplished according to the invention as illustrated in FIGS. 4 and 5 wherein the fact stock ply 22 is provided with a generally rectangular die cut 90 inwardly of all four edges thereof. In the disclosed embodiment, the die cut 90 is a closed die cut in the sense that it is continuous without ends and completely severs a label portion 92 within the die cut 90 from the remainder 94 of the ply 22. Thus, because of such complete severance, when the release liner 24 is peeled from the face stock ply 22 as illustrated in FIG. 5, the label 92 will remain on the release liner 24 while the rectangular frame 94 will have exposed a rectangular pattern of pressure sensitive adhesive 28 by which the form may be adhered to a carton or the like just as with the prior embodiment. The label 92 may then be removed from the release liner 24 when and if desired.

In some instances, additional die cuts such as those illustrated at 96 and 98 in FIGS. 4 and 5 may be utilized in connection with the die cut 90 to provide plural labels out of the label section 92. The labels resulting from the use of the die cuts may be preprinted or may be imaged as a result of the application of printing pressure to the ply 10 when the form is filled out.

From the foregoing, it will be appreciated that a business form made according to the invention has a number of advantages. For one, it does not rely on heat sealing to secure the transparent ply 16 to the remainder of the form, thereby providing for economy of fabrication. For another, through the use of cold glue adhesive to joint the transparent ply 16 to the remainder of the form, paper tear will result whenever there has been separation of the ply 16 from the remainder of the form to provide an indication of such an occurrence. The use of a cold glue adhesive allows relatively high manufacturing speeds.

Finally, the form is ideally suited for the provision of additional labels with the form without increasing the thickness of the form which would adversely affect the imaging characteristics thereof.

We claim:

1. A business form comprising:

a sheet of face stock having pressure sensitive adhesive on one side thereof;

a release liner removably adhered to said pressure sensitive adhesive;

a transparent sheet adhered along two spaced marginal edges to said face stock sheet on the side thereof opposite said one side with at least one marginal edge terminating short of the corresponding marginal edge of the face stock sheet and being free from adhesion thereto; and at least one imaging data sheet between said transparent sheet and said face stock sheet and having marginal edges inward of said two marginal edges so as to be free from adhesion to said transparent sheet and said face stock sheet thereat and having a third marginal edge extending past said one marginal edge to be grippable thereat and removed from said form.

2. The business form of claim 1 wherein said third marginal edge is located between said one marginal edge and said corresponding edge.

3. The business form of claim 1 wherein there are a plurality of said data sheets and said third marginal edges are shingled and located between said one marginal edge and said corresponding edge.

4. The business form of claim 3 wherein said data sheets are connected to one of said transparent and face stock sheets at their marginal edges opposite said third marginal edge and have lines of weakening adjacent thereto whereby said data sheets may be individually severed thereat to be removed from the remainder of the business form.

5. The business form of claim 1 further including at least one record sheet overlying said transparent sheet and connected thereto, and a line of weakness in said record sheet along which the same may be severed to be detached from said transparent and face stock sheet.

6. The business form of claim 1 further including die cut means in said face stock sheet inwardly of at least two edges thereof and defining at least one label separate from the remainder of said face stock sheet, removal of said release liner taking said label with said release liner while exposing adhesive on said remainder of said face stock sheet.

7. The business form of claim 6 wherein said die cut means comprises a closed die cut wholly within the marginal edges of said face stock sheet.

8. The business form of claim 7 wherein said closed die cut is generally rectangular.

9. The business form of claim 1 wherein said pressure sensitive adhesive does not extend completely to at least one edge of said release liner.

10. A business form comprising:

a sheet of face stock having pressure sensitive adhesive on one side thereof;

a release liner removably adhered to said pressure sensitive adhesive;

a transparent sheet adhered along two spaced marginal edges to said face stock sheet on the side thereof opposite said one side with at least one marginal edge terminating short of the corresponding marginal edge of the face stock sheet and being free from adhesion thereto;

a plurality of pressure sensitive imaging data sheets between said transparent sheet and said face stock sheet and having marginal edges inward of said two marginal edges so as to be free from adhesion to said transparent sheet and said face stock sheet thereat and having shingled third marginal edges extending past said one marginal edge to be grippable thereat and removed from said form;

at least one record sheet in overlying relation to said transparent sheet and having a connection thereto at a marginal edge opposite said one marginal edge thereof; and a line of weakening in said record ply closely adjacent said connection.

11. The business form of claim 10 wherein said face stock is paper and said transparent sheet is adhered thereto by a cold glue pressure sensitive adhesive that will cause fiber tear of said face stock if said transparent sheet is pulled therefrom.

12. A business form comprising:

a sheet of face stock having pressure sensitive adhesive on one side thereof;

a release liner removably adhered to said pressure sensitive adhesive;

a transparent sheet adhered along two spaced marginal edges to said face stock sheet on the side thereof opposite said one side with at least one marginal edge terminating short of the corresponding marginal edge of the face stock sheet and being free from adhesion thereto;

a plurality of pressure sensitive imaging data sheets between said transparent sheet and said face stock sheet and having marginal edges inward of said two marginal edges so as to be free from adhesion to said transparent sheet and said face stock sheet thereat and having shingled third marginal edges extending past said one marginal edge to be grippable thereat and removed from said form; and a die cut in said release liner sheet defining a label removable therefrom with said release liner.

* * * * *

UNITED STATES PATENT AND TRADEMARK OFFICE

CERTIFICATE OF CORRECTION

PATENT NO. : 4,928,874

DATED : May 29, 1990

INVENTOR(S) : Paul T. Henry et al

It is certified that error appears in the above-indentified patent and that said Letters Patent is hereby corrected as shown below:

On the title page, item [56] - please insert:

| | | | |
|---|---|---|---|
| --3,339,826 | 9/1967 | Beskind..... | 229/68 |
| 3,580,489 | 5/1971 | Oettinger..... | 229/70 |
| 4,598,935 | 7/1986 | Stewart..... | 283/81 |
| 4,614,361 | 9/1986 | Foster..... | 281/8 R |

Signed and Sealed this

Sixth Day of June, 1995

Bruce Lehman

*Attest:*

BRUCE LEHMAN

*Attesting Officer*

*Commissioner of Patents and Trademarks*